US009945201B2

(12) United States Patent
Tamosaitis et al.

(10) Patent No.: US 9,945,201 B2
(45) Date of Patent: Apr. 17, 2018

(54) CORRUGATED ENERGIZING RING FOR USE WITH A SPLIT LOCKDOWN RING

(71) Applicant: GE Oil & Gas Pressure Control LP, Houston, TX (US)

(72) Inventors: Donald James Tamosaitis, Houston, TX (US); Chijie Lin, Houston, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 192 days.

(21) Appl. No.: 15/092,200

(22) Filed: Apr. 6, 2016

(65) Prior Publication Data

US 2016/0298410 A1 Oct. 13, 2016

Related U.S. Application Data

(60) Provisional application No. 62/143,932, filed on Apr. 7, 2015.

(51) Int. Cl.
*E21B 33/03* (2006.01)

(52) U.S. Cl.
CPC ..... *E21B 33/03* (2013.01)

(58) Field of Classification Search
CPC .... E21B 49/08; E21B 2049/085; E21B 33/04; E21B 33/043; E21B 33/03; E21B 33/02; E21B 23/00; F16J 15/028
See application file for complete search history.

(56) References Cited

U.S. PATENT DOCUMENTS 3,561,527 A * 2/1971 Nelson ..... E21B 33/043 285/123.2
3,649,032 A * 3/1972 Nelson ..... E21B 33/043 277/322

(Continued)

FOREIGN PATENT DOCUMENTS

EP 0289107 A2 11/1988
GB 2180016 A 3/1987

OTHER PUBLICATIONS

International search report and written opinion issued in connection with corresponding application No. PCT/US2016/026389 dated Jun. 17, 2016.

*Primary Examiner* — Kipp C Wallace
(74) *Attorney, Agent, or Firm* — Hogan Lovells US LLP

(57) ABSTRACT

A wellhead assembly includes first and second wellhead members. An annular lock groove is located on an inner or an outer diameter surface of the first wellhead member. An annular lock ring is supported on an annular shoulder of the second wellhead member and is radially moveable between an unset position and a set position where a locking profile of the annular lock ring engages the annular lock groove. The second wellhead member is positioned concentrically with the first wellhead member, defining an annulus between the first and second wellhead members. An energizing ring is positioned in the annulus and axially movable between an unengaged position and an engaged position. The energizing ring has an engaging portion with a corrugated shape in cross section that is interference fit between the annular lock ring and the second wellhead member when the energizing ring is in the engaged position.

20 Claims, 5 Drawing Sheets

(56) References Cited

U.S. PATENT DOCUMENTS

| | | | | |
|---|---|---|---|---|
| 4,597,448 | A * | 7/1986 | Baugh | E21B 33/043 166/125 |
| 4,702,481 | A * | 10/1987 | Brammer | E21B 33/04 277/328 |
| 4,900,067 | A * | 2/1990 | Jansen | E21B 33/04 277/328 |
| 5,060,724 | A | 10/1991 | Brammer et al. | |
| 5,174,376 | A | 12/1992 | Singeetham | |
| 8,925,639 | B2 * | 1/2015 | Benson | E21B 33/0422 166/348 |
| 9,388,655 | B2 * | 7/2016 | Sommerfeld | E21B 33/04 |
| 2006/0231248 | A1 * | 10/2006 | Ford | E21B 33/043 166/89.1 |
| 2013/0248196 | A1 | 9/2013 | Gette et al. | |

* cited by examiner

CORRUGATED ENERGIZING RING FOR USE WITH A SPLIT LOCKDOWN RING

CROSS REFERENCE TO RELATED APPLICATION

This application claims priority to and the benefit of co-pending U.S. Provisional Application Ser. No. 62/143,932, filed Apr. 7, 2015, titled "Corrugated Energizing ring For Use With A Split Lockdown Ring," the full disclosure of which is hereby incorporated herein by reference in its entirety for all purposes.

BACKGROUND

1. Field of Disclosure

This invention relates in general to wellhead assemblies, and in particular to energizing rings used to lock down concentric tubular members.

2. Description of Related Art

Wellhead assemblies can include concentric tubular shaped members. Outer and inner wellhead members can be, for example, a wellhead housing, casing hanger, tubing hanger, seal assembly, or other member with a generally ring shaped cross section. Throughout the life of the wellhead assembly, forces within the wellhead assembly can push the inner wellhead member axially up and down. As an example, when the wellhead members are subjected to high pressures, the high pressures can cause the inner wellhead member to move axially upward relative to the outer wellhead member. Thermal expansion can also lead to relative axial movement between outer and inner wellhead members.

Small relative axial movement can also occur between the inner wellhead member and the outer wellhead member due to stack up tolerances. This motion can cause wear of the adjacent surfaces, jeopardizing the integrity of the inner wellhead member and the outer wellhead member. Relative movement between components is, for example, of particular concern for metal to metal seal elements. In cases where small relative axial movement is undesirable, a preload force can be generated through the load path between lockdown ring flanks and mating faces of an annular recess within the entire stack up tolerance range, to reduce or eliminate any relative axial movement between the inner wellhead member and the outer wellhead member.

A lockdown ring can be used to prevent or reduce relative axial movement between outer and inner wellhead members. Lockdown rings can be energized by an energizing ring. Once the energizing ring energizes the lockdown ring, the energizing ring stays in place to maintain the radial position of the lockdown ring. In some current wellhead systems, continued pressure and force from the lockdown ring on the energizing ring, can be sufficient to move the lockdown ring from the set position to an unset position. In addition, due to the stack up tolerances, the lock ring may not land in a predicable location and may not provide sufficient locking forces to prevent relative movement between outer and inner wellhead members.

In some current energizing rings, the engaging surfaces of the energizing ring are straight. Such energizing rings can only displace the lock ring a set radial amount. Therefore depending on the stack up tolerances, such energizing rings can allow for more than acceptable amounts of relative axial movement between the inner wellhead member and the outer wellhead member.

In other current energizing rings, a taper can be incorporated into the energizing ring. A tapered energizing ring interface ensures contact of the lock ring flanks throughout the stack up tolerance range but requires an additional lock down device for the energizing ring, which can require a separate tool and additional trips into the well to operate. In addition there is not positive stop for the energizing ring so the exact set position of the energizing ring will be unknown.

SUMMARY OF THE DISCLOSURE

The methods and systems of the current disclosure provide an energizing ring that minimizes the relative movement of the inner and outer wellhead members. Embodiments described herein provide a positive stop for the energizing ring for controlling the final set position of the energizing ring and do not require an additional lock down device. This can simplify the running of the assembly and provide cost and time savings. Embodiments of this disclosure include an energizing ring with a corrugated profile that allows for sufficient radial interference with the lock ring to ensure contact of the lock ring flanks through the stack up tolerance range while staying within reasonable setting load limits.

In an embodiment of the current disclosure, a wellhead assembly includes a first wellhead member, the first wellhead member having a first bore with a central axis. An annular lock groove is located on one of an inner diameter surface and an outer diameter surface of the first wellhead member. An annular lock ring is supported on an annular shoulder of a second wellhead member, the annular lock ring being radially moveable between an unset position and a set position where a locking profile of the annular lock ring engages the annular lock groove. The second wellhead member is positioned concentrically with the first wellhead member around the axis, defining an annulus between the first wellhead member and the second wellhead member. An energizing ring is positioned in the annulus, the energizing ring being axially movable between an unengaged position and an engaged position. The energizing ring has an engaging portion with a corrugated shape in cross section that is interference fit between the annular lock ring and the second wellhead member when the energizing ring is in the engaged position.

In an alternate embodiment, a wellhead assembly includes an outer wellhead member, the outer wellhead member having a bore with an axis. An inner wellhead member is concentrically located within the bore of the outer wellhead member and defines an annulus between the inner wellhead member and the outer wellhead member. An annular lock groove is located on one of an inner diameter surface of the bore of the outer wellhead member and an outer diameter surface of the inner wellhead member. An annular lock ring is positioned in the annulus, the annular lock ring being radially moveable between an unset position and a set position and having a locking profile for engaging the annular lock groove in the set position, resisting relative axial movement between the inner wellhead member and the outer wellhead member. An energizing ring is positioned in the annulus, the energizing ring being axially movable between an unengaged position and an engaged position, the energizing ring having an engaging portion with a corrugated shape in cross section sized to push the annular lock ring from the unset position to the set position as the energizing ring moves from the unengaged position to the engaged position and retain the annular lock ring in the set position with an interference fit.

In yet another alternate embodiment, a method of developing a well with a wellhead assembly includes providing a first wellhead member, the first wellhead member having a first bore with a central axis. An annular lock groove is formed on one of an inner diameter surface and an outer diameter surface of the first wellhead member. An annular lock ring is supported on an annular shoulder of a second wellhead member, the annular lock ring being radially moveable between an unset position and a set position where a locking profile of the annular lock ring engages the annular lock groove. The second wellhead member is concentrically positioned with the first wellhead member around the axis, defining an annulus between the first wellhead member and the second wellhead member. An energizing ring is moved axially within the annulus between an unengaged position and an engaged position where the annular lock ring is in the set position. The energizing ring has an engaging portion with a corrugated shape in cross section to form an interference fit between the annular lock ring and the second wellhead member when the energizing ring is in the engaged position.

BRIEF DESCRIPTION OF THE DRAWINGS

Some of the features and benefits of the present disclosure having been stated, others will become apparent as the description proceeds when taken in conjunction with the accompanying drawings, in which.

DETAILED DESCRIPTION OF THE DISCLOSURE

Figure 1:
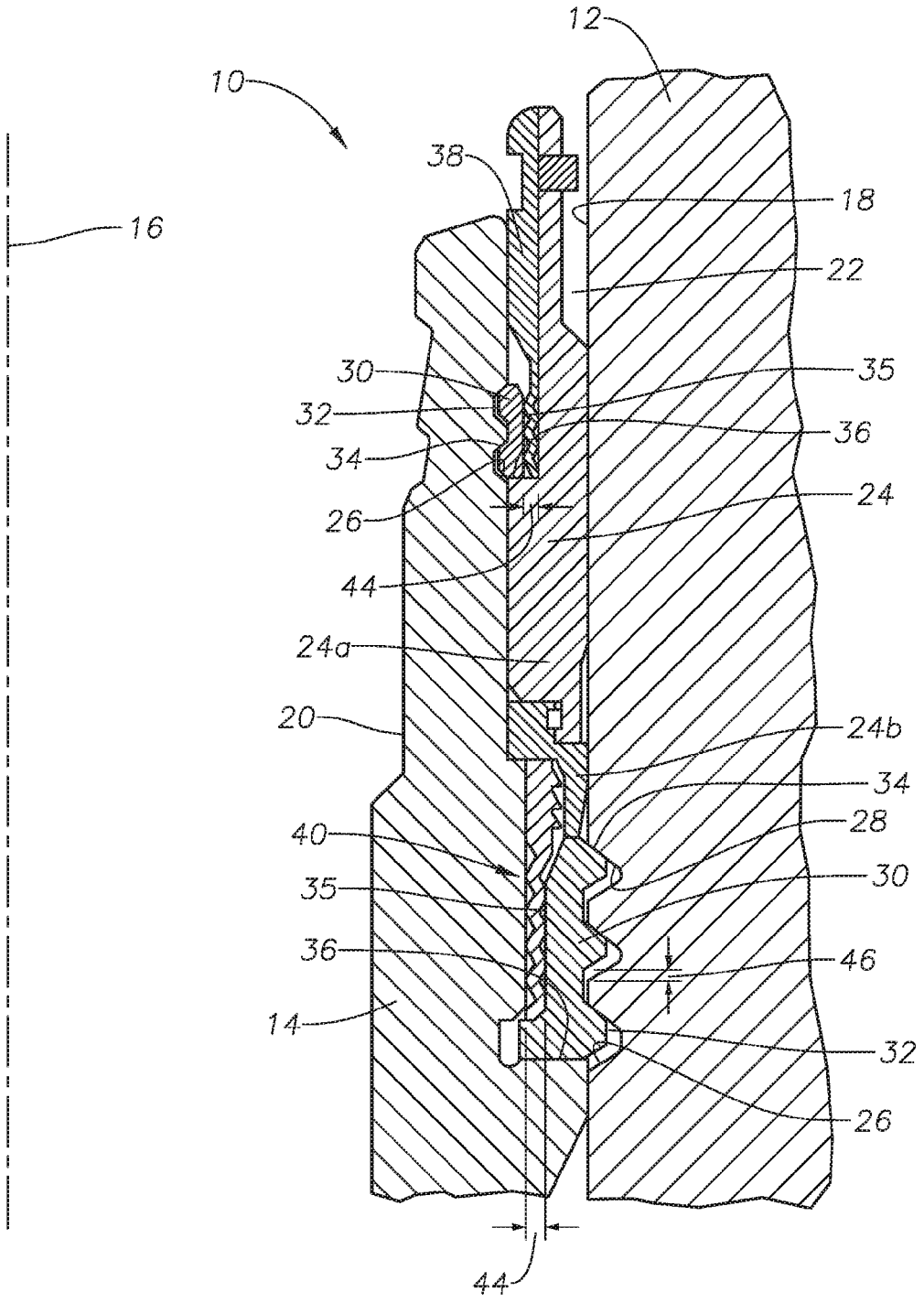
FIG. 1 is a section view of a portion of a wellhead assembly with corrugated energizing rings, in accordance with an embodiment of this disclosure, shown with the corrugated energizing rings in an engaged position.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, wellhead assembly 10 can include outer wellhead member 12 and inner wellhead member 14. Wellhead assembly 10 can be located subsea, on an offshore platform, or on land and is disposed over a well (not shown). Wellhead assembly 10 can include a wellhead housing, a production tree over the housing and flow lines connected to the tree or the wellhead assembly (not shown).

Both outer wellhead member 12 and inner wellhead member 14 are generally tubular shaped members centered around central axis 16. Outer wellhead member 12 can concentrically circumscribe inner wellhead member 14. Outer wellhead member 12 has outer member bore 18 and inner wellhead member 14 is located within outer member bore 18. Inner wellhead member 14 includes inner member bore 20. Annulus 22 is defined between an inner diameter surface of outer member bore 18 and an outer surface of inner wellhead member 14.

Seal assembly 24 of the example configuration of FIG. 1 is another generally tubular shaped member that is centered around central axis 16. Seal assembly 24 concentrically circumscribes inner wellhead member 14 and is concentrically circumscribed by outer wellhead member 12. Therefore, relative to inner wellhead member 14, seal assembly 24 is a second outer wellhead member, and relative to outer wellhead member 12, seal assembly 24 is a second inner wellhead member. Seal assembly 24 can include a main seal member 24*a* and a secondary seal member 24*b*. In alternate embodiments, seal assembly 24 can have any known configuration that provides a seal between the inner diameter surface of outer member bore 18 and the outer surface of inner wellhead member 14.

Figure 2:
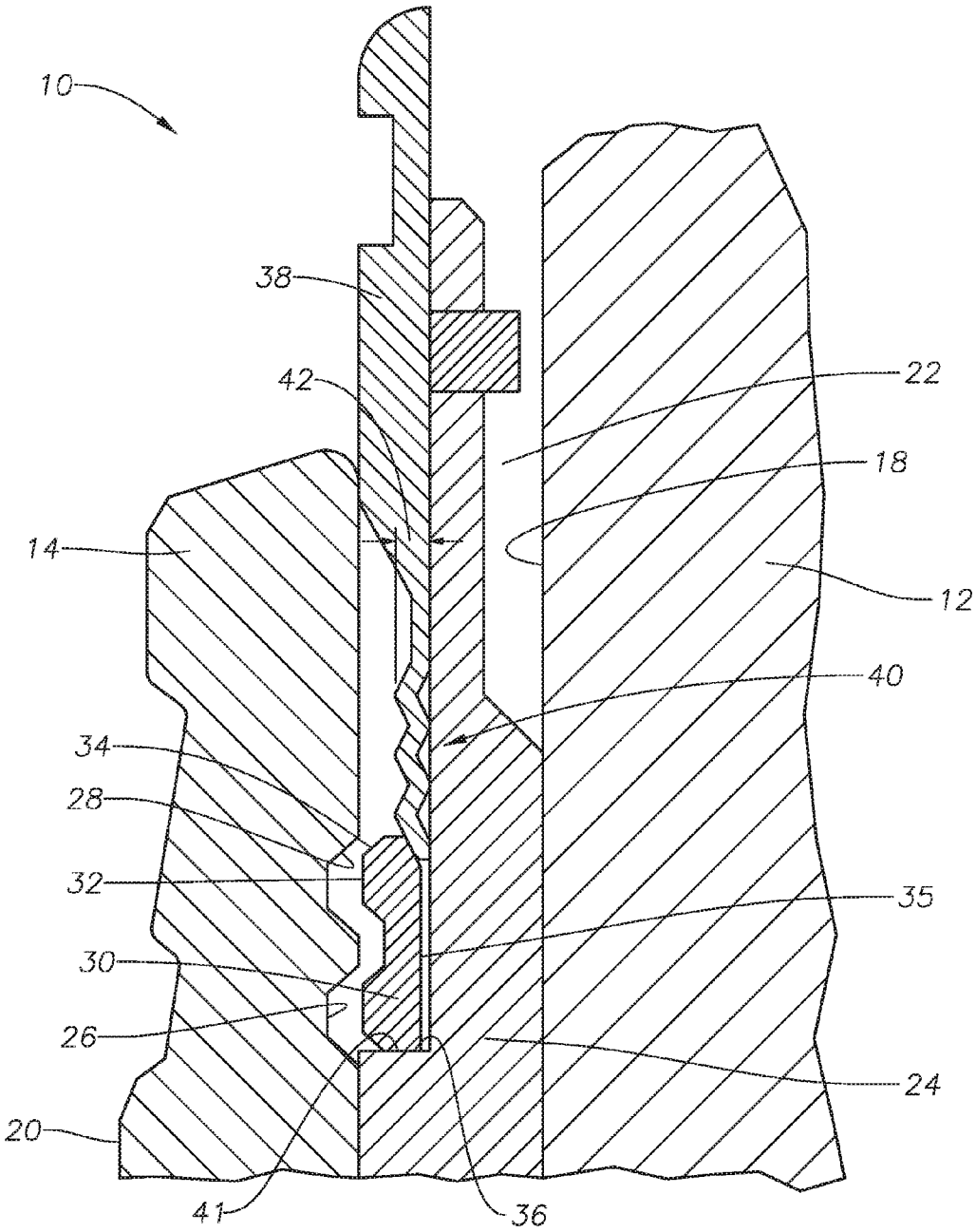
FIG. 2 is a section view of a portion of the wellhead assembly of FIG. 1, with a corrugated energizing ring, in accordance with an embodiment of this disclosure, shown with the corrugated energizing ring in an unengaged position.

In order to resist axial movement between concentric wellhead members, a lock ring and groove system can be utilized. Looking at FIG. 3, in order to resist axial movement between outer wellhead member 12 and inner wellhead member 14, annular lock groove 26 can be located on inner diameter surface of outer wellhead member 12. Annular lock groove 26 can include one or more concentric rings of indentations or channels located on the inner diameter surface of outer wellhead member 12. Each channel of annular lock groove 26 can have groove flank 28. Groove flank 28 can be a sloped downward facing mating shoulder. In cross section, each channel of annular lock groove 26 can have a general "U" or "V" shape (FIG. 3) or can have a flat portion at a deepest portion of the channel (FIG. 2).

The lock ring and groove system also includes annular lock ring 30. Annular lock ring 30 can be a generally ring shaped split member with a locking profile 32 that is shaped to engage annular lock groove 26. Locking profile 32 of annular lock ring 30 can have one or more concentric ridges that are similar in shape in cross section to the cross sectional shape of annular lock groove 26. Annular lock ring 30 can include lock ring flank 34. Lock ring flank 34 can be an upward facing shoulder that engages groove flank 28 to resist upward relative movement of annular lock ring 30 relative to annular lock groove 26. On a side of annular lock ring 30 of annular lock ring 30 opposite locking profile 32 is a non-profiled surface 35. Non-profiled surface 35 can be a generally smooth cylindrical surface.

Figure 3:
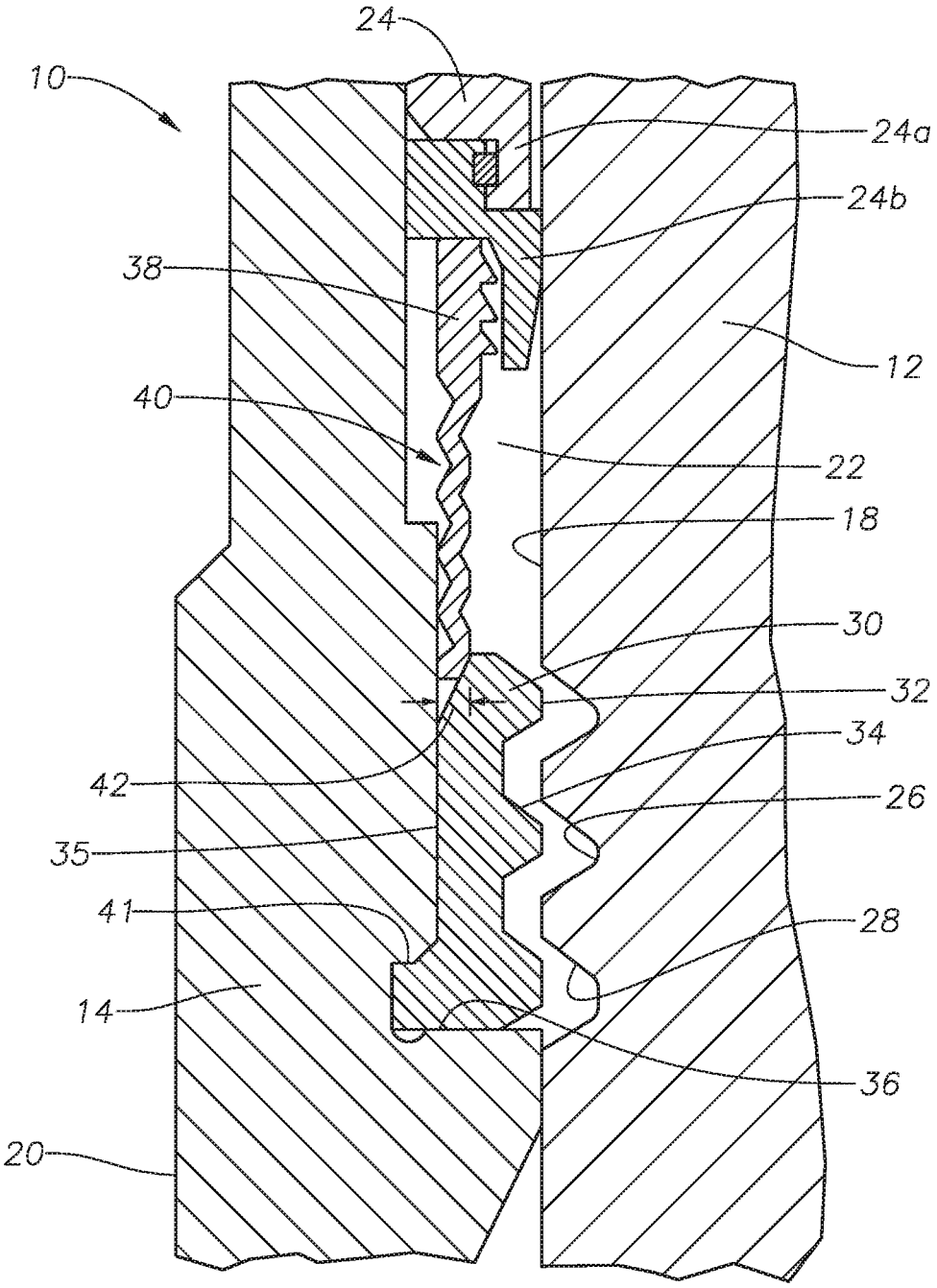
FIG. 3 is a section view of a portion of the wellhead assembly of FIG. 1, with a corrugated energizing ring, in accordance with an embodiment of this disclosure, shown with the corrugated energizing ring in an unengaged position.
Figure 4:
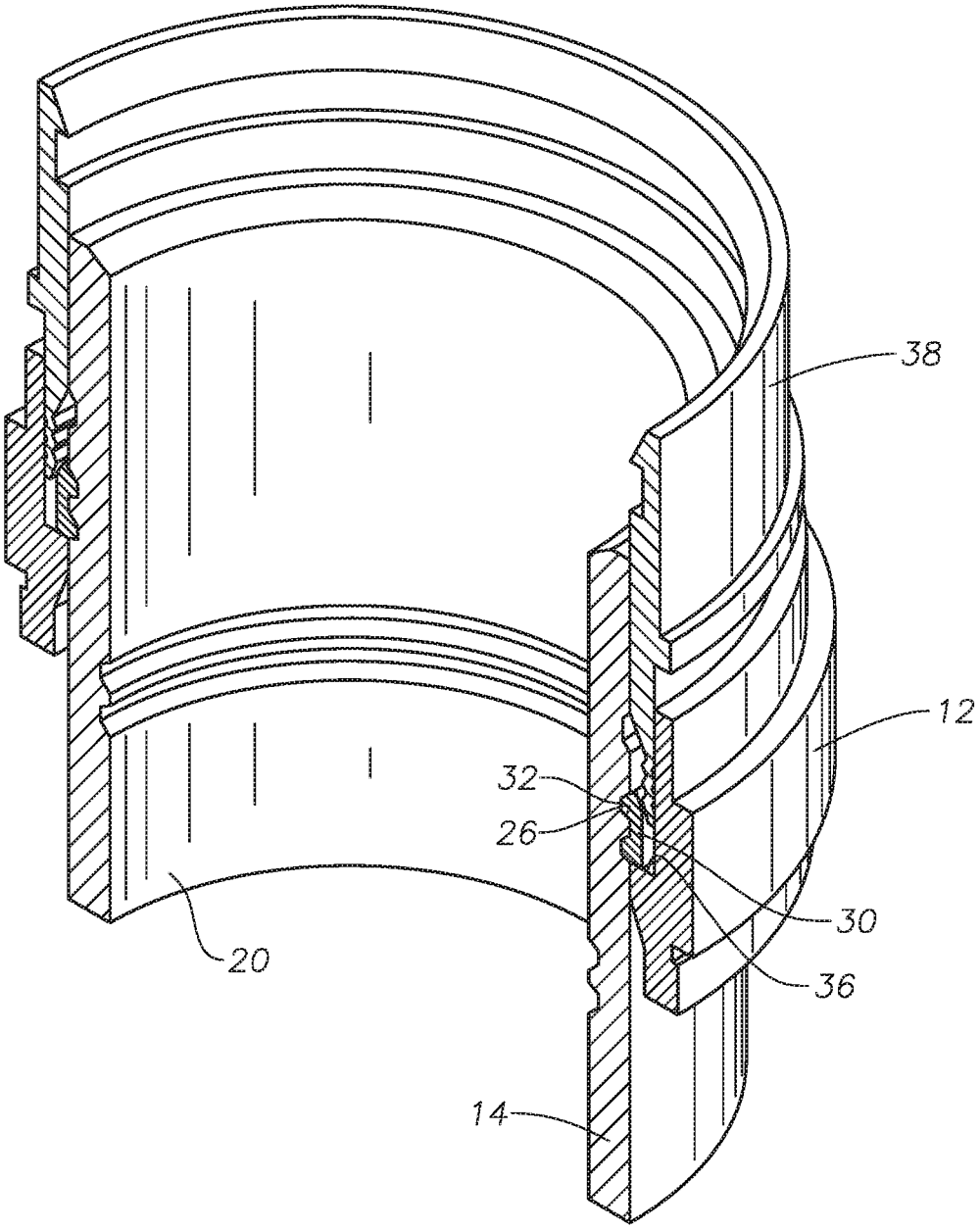
FIG. 4 is section perspective view of a portion of a wellhead assembly with a corrugated energizing ring, in accordance with an embodiment of this disclosure, shown with the corrugated energizing ring in a partially engaged position.
Figure 5:
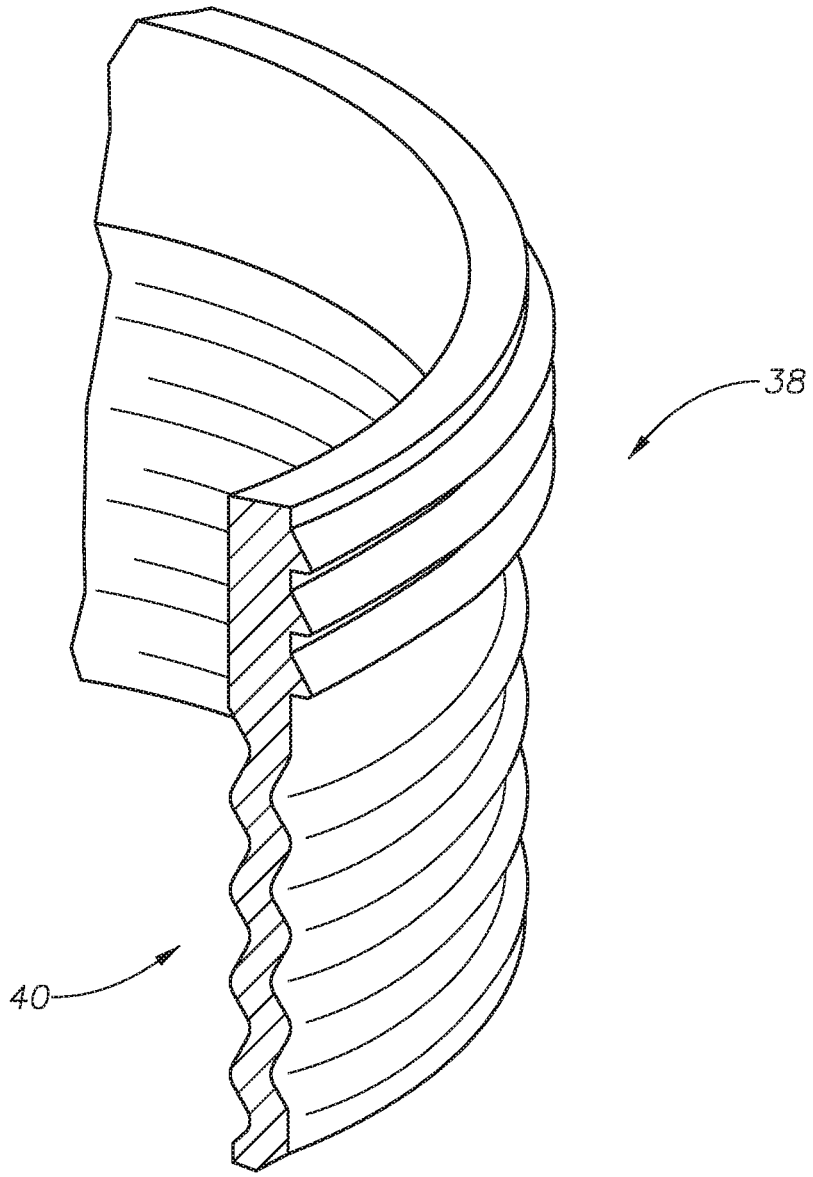
FIG. 5 is a sectioned perspective view of a portion of a corrugated energizing ring, in accordance with an embodiment of this disclosure.

Annular lock ring 30 can be located within annulus 22 and supported on annular shoulder 36. In the example of FIG. 3, annular shoulder 36 is part of inner wellhead member 14. Annular lock ring 30 can be radially moveable between an unset position (FIGS. 2-3) and a set position (FIG. 1). Annular lock ring 30 is biased so that in the unset position, annular lock ring 30 can travel axially past annular lock groove 26 without locking profile 32 engaging annular lock groove 26. In the set position, annular lock ring 30 is either expanded or collapsed, as applicable, so that locking profile 32 engages annular lock groove 26. In the example of FIG. 3, annular lock ring 30 is biased radially inward and moving annular lock ring 30 to an engaged position includes expanding annular lock ring 30 so that the engagement of locking profile 32 with annular lock groove 26 resists upward axial movement of inner wellhead member 14 relative to outer wellhead member 12.

Energizing ring 38 is used to push annular lock ring 30 from the unset position to the set position as energizing ring 38 moves from an unengaged position (FIGS. 2-3) to the engaged position (FIG. 1). Energizing ring 38 can have an engaging portion 40. Engaging portion 40 has a corrugated shape in cross section. When energizing ring 38 is in the engaged position, an end of energizing ring 38 can engage annular stop shoulder 41 (FIGS. 2-3) within annulus 22 to act as a positive stop of energizing ring 38. In the example embodiment of FIG. 3, annular stop shoulder 41 is part of annular lock ring 30. In alternate embodiments, annular stop shoulder 41 can be annular shoulder 36 (FIG. 2). Energizing ring 38 can also have a tool profile for mating with an installation tool for placing energizing ring 38 within wellhead assembly 10 and for moving energizing ring 38 between engaged and unengaged positions.

In the example of FIG. 3, when energizing ring 38 is in a set position, energizing ring 38 is interference fit between non-profiled surface 35 of annular lock ring 30 and the outer diameter surface of inner wellhead member 14. In such an embodiment, non-profiled surface 35 of annular lock ring 30 is an inner diameter surface of annular lock ring 30. The interference fit is of sufficient strength to retain annular lock ring 30 in the set position and retain energizing ring 38 in the engaged position without the use of an additional locking member, even during ongoing long term operation of the wellhead assembly.

In order to achieve a sufficient interference fit, the radial width 42 (FIGS. 2-3) of engaging portion 40 measured from a peak on one side of engaging portion 40 to the peak on an opposite side of engaging portion 40 is greater than a radial gap 44 (FIG. 1) between non-profiled surface 35 of annular lock ring 30 and the outer diameter surface of inner wellhead member 14 when annular lock ring 30 is in the set position.

The corrugated shape of engaging portion 40 of energizing ring 38 in cross section can be formed of concentric ridges and valleys. In alternate embodiments, the corrugated shape of engaging portion 40 of energizing ring 38 in cross section can follow a helical pattern. However, in order for the radial stiffness of the corrugated shape of engaging portion 40 to be generally constant over a length of the corrugated shape of the engaging portion 40, and for the radial stiffness to remain generally constant over a range of radial gaps 44, a pattern of concentric ridges and valleys is more efficient to design and manufacture.

Because of manufacturing tolerances, the exact final axial location of inner wellhead member 14 relative to outer wellhead member 12 is uncertain. Locking profile 32 of annular lock ring 30 and annular lock groove 26 can be designed to allow annular lock ring 30 to resist axial movement of inner wellhead member 14 relative to outer wellhead member 12 over a range of relative positions. The stack up tolerance range is the distance through which the bottom of the split lock ring can be located and still provide the required locking capacity. In the example of FIG. 1, because lock ring flank 34 and groove flank 28 are sloped surfaces, the extend of radial engagement of annular lock ring 30 within annular lock groove 26 when annular lock ring 30 is in a set position will depend on the final axial location of inner wellhead member 14 relative to outer wellhead member 12. In the example embodiment of FIG. 1, lower annular lock ring 30 is in a set position and has a tolerance allowance 46, which is an axial distance over which inner wellhead member 14 could have been located with annular lock ring 30 still being capable of being in a set position to restrict axial movement of inner wellhead member 14 relative to outer wellhead member 12.

Engaging portion 40 of energizing ring 38 can be shaped so that if radial gap 44 is a minimum value the setting load is not excessive, yet if radial gap 44 is a maximum value, the radial stiffness of engaging portion 40 of energizing ring 38 will be sufficient to retain annular lock ring 30 in the set position and retain energizing ring 38 in the engaged position. The thickness of material used to form the corrugated cross section of engaging portion 40 of energizing ring 38 as well as the number of corrugations, the angle of the corrugations, the shape of the corrugations and other parameters of the corrugated section can be selected to meet the performance requirements for locking down inner or outer wellhead members of a particular wellhead assembly.

Although the embodiment of FIG. 3 with annular lock groove 26 located on an inner diameter surface of outer wellhead member 12 and annular lock ring 30 being biased radially inward, and pushed radially outward with energizing ring 38 has been described, alternative embodiments are also disclosed herein or otherwise understood. In alternate embodiments, any of inner wellhead member 14, outer wellhead member 12, or seal assembly 24 can be a first wellhead member and another of inner wellhead member 14, outer wellhead member 12, or seal assembly 24 can be a second wellhead member. In certain of such alternate embodiments, when annular lock ring 30 is biased radially inward (lower annular lock ring of FIG. 1), the first wellhead member is an outer wellhead member, and the second wellhead member is located within the first bore of the outer wellhead member. Alternately, when annular lock ring 30 is biased radially outward (upper annular lock ring of FIG. 1), the first wellhead member is an inner wellhead member that is located within a second bore of the second wellhead member.

Looking, for example, at FIG. 2, an alternate configuration to the embodiment of FIG. 3 is shown. In the embodiment of FIG. 2, annular lock groove 26 is located on outer diameter surface of inner wellhead member 14. Annular lock ring is supported on annular shoulder 36 that is part of seal assembly 24. Annular lock ring 30 is biased radially outward and moving annular lock ring 30 to an engaged position includes collapsing annular lock ring 30 so that the engagement of locking profile 32 with annular lock groove 26 resists upward axial movement of seal assembly 24 relative to inner wellhead member 14.

Looking at FIGS. 1-2, when energizing ring 38 is in the engaged position, the end of energizing ring 38 engages annular stop shoulder 41 that is annular shoulder 36 and part of seal assembly 24. When energizing ring 38 is in a set position, energizing ring 38 is interference fit between non-profiled surface 35 of annular lock ring 30 and an inner diameter surface of seal assembly 24. Non-profiled surface 35 of annular lock ring 30 is an outer diameter surface of annular lock ring 30. In such an embodiment, the radial width 42 (FIG. 2) of engaging portion 40 measured from a peak on one side of engaging portion 40 to the peak on an opposite side of engaging portion 40 is greater than a radial gap 44 (FIG. 1) between non-profiled surface 35 of annular lock ring 30 and the inner diameter surface of seal assembly 24 when annular lock ring 30 is in the set position.

In an example of operation, the first and second, or inner and outer wellhead members 12, 14 can be provided. Annular lock ring 30 can be supported by, and carried into wellhead assembly 10 on, annular shoulder 36. Energizing ring 38 can be moved axially within annulus 22 between an unengaged position and an engaged position. Energizing ring 38 can be moved within annulus 22 with a downhole tool. When energizing ring 38 is in the engaged position, annular lock ring 30 is in the set position.

In the example of FIG. 2, annular lock ring 30 is biased radially outward and moving annular lock ring 30 to an engaged position includes collapsing annular lock ring 30 radially inward with energizing ring 38 to engage annular lock groove on the outer diameter surface of first or inner wellhead member 14. Annular lock ring 30 is collapsed by pushing energizing ring 38 along non-profiled surface 35, which is an outer diameter surface of annular lock ring 30. In such an embodiment, non-profiled surface 35 of annular lock ring 30 is an outer diameter surface of annular lock ring 30.

In the example of FIG. 3, annular lock ring 30 is biased radially inward and moving annular lock ring 30 to an engaged position includes expanding annular lock ring 30 radially outward with energizing ring 38 to engage annular lock groove on the inner diameter surface of second or outer wellhead member 12. Annular lock ring 30 is expanded by pushing energizing ring 38 along non-profiled surface 35, which is an outer diameter surface of annular lock ring 30. In such an embodiment, non-profiled surface 35 of annular lock ring 30 is an inner diameter surface of annular lock ring 30.

The terms "vertical", "horizontal", "upward", "downward", "above", and "below" and similar spatial relation terminology are used herein only for convenience because elements of the current disclosure may be installed in various relative positions.

The system and method described herein, therefore, are well adapted to carry out the objects and attain the ends and advantages mentioned, as well as others inherent therein. While a presently preferred embodiment of the system and method has been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

What is claimed is:

1. A wellhead assembly comprising:

a first wellhead member, the first wellhead member having a first bore with a central axis;

an annular lock groove located on one of an inner diameter surface and an outer diameter surface of the first wellhead member;

an annular lock ring supported on an annular shoulder of a second wellhead member, the annular lock ring being radially moveable between an unset position and a set position where a locking profile of the annular lock ring engages the annular lock groove, wherein the second wellhead member is positioned concentrically with the first wellhead member around the central axis, defining an annulus between the first wellhead member and the second wellhead member; and an energizing ring positioned in the annulus, the energizing ring being axially movable between an unengaged position and an engaged position, the energizing ring having an engaging portion with a corrugated shape in cross section that is interference fit between the annular lock ring and the second wellhead member when the energizing ring is in the engaged position.

2. The wellhead assembly according to claim 1, wherein the corrugated shape of the energizing ring in cross section is formed of concentric ridges and valleys.

3. The wellhead assembly according to claim 1, wherein the annular lock ring is biased radially outward and the first wellhead member is an inner wellhead member that is located within a second bore of the second wellhead member.

4. The wellhead assembly according to claim 1, wherein the annular lock ring is biased radially inward, the first wellhead member is an outer wellhead member, and the second wellhead member is located within the first bore.

5. The wellhead assembly according to claim 1, wherein the annular lock ring has an upward facing shoulder that engages a downward facing mating shoulder of the annular lock groove when the annular lock ring is in the set position.

6. The wellhead assembly according to claim 1, wherein a radial width of the engaging portion measured from a peak on one side of the engaging portion to the peak on an opposite side of the engaging portion is greater than a radial gap between a non-profiled surface of the annular lock ring and an opposite facing surface of the second wellhead member, the non-profiled surface of the annular lock ring facing opposite of the locking profile.

7. The wellhead assembly according to claim 1, wherein an end of the energizing ring engages an annular stop shoulder within the annulus when the energizing ring is in the engaged position.

8. The wellhead assembly according to claim 1, wherein a radial stiffness of the corrugated shape of the engaging portion is constant over a length of the corrugated shape of the engaging portion.

9. A wellhead assembly comprising:

an outer wellhead member, the outer wellhead member having a bore with an axis;

an inner wellhead member concentrically located within the bore of the outer wellhead member and defining an annulus between the inner wellhead member and the outer wellhead member;

an annular lock groove located on one of an inner diameter surface of the bore of the outer wellhead member and an outer diameter surface of the inner wellhead member;

an annular lock ring positioned in the annulus, the annular lock ring being radially moveable between an unset position and a set position and having a locking profile for engaging the annular lock groove in the set position, resisting relative axial movement between the inner wellhead member and the outer wellhead member; and an energizing ring positioned in the annulus, the energizing ring being axially movable between an unengaged position and an engaged position, the energizing ring having an engaging portion with a corrugated shape in cross section sized to push the annular lock ring from the unset position to the set position as the energizing ring moves from the unengaged position to the engaged position and retain the annular lock ring in the set position with an interference fit.

10. The wellhead assembly according to claim 9, wherein the corrugated shape of the energizing ring in cross section is formed of concentric ridges and valleys.

11. The wellhead assembly according to claim 9, wherein the annular lock ring has an upward facing shoulder that engages a downward facing mating shoulder of the annular lock groove when the annular lock ring is in the set position.

12. The wellhead assembly according to claim 9, wherein a radial width of the engaging portion measured from a peak on one side of the engaging portion to the peak on an opposite side of the engaging portion is greater than a radial gap between a non-profiled surface of the annular lock ring and the other of the inner diameter surface of the bore of the outer wellhead member and the outer diameter surface of the inner wellhead member, the non-profiled surface of the annular lock ring facing opposite of the locking profile.

13. The wellhead assembly according to claim 9, further including an annular stop shoulder located within the annulus and an end of the energizing ring engages the annular stop shoulder when the energizing ring is in the engaged position.

14. The wellhead assembly according to claim 9, wherein a radial stiffness of the corrugated shape of the engaging portion is constant over a length of the corrugated shape of the engaging portion.

15. A method of developing a well with a wellhead assembly, the method comprising:

providing a first wellhead member, the first wellhead member having a first bore with a central axis;

forming an annular lock groove on one of an inner diameter surface and an outer diameter surface of the first wellhead member;

supporting an annular lock ring on an annular shoulder of a second wellhead member, the annular lock ring being radially moveable between an unset position and a set position where a locking profile of the annular lock ring engages the annular lock groove;

positioning the second wellhead member concentrically with the first wellhead member around the central axis, defining an annulus between the first wellhead member and the second wellhead member; and moving an energizing ring axially within the annulus between an unengaged position and an engaged position where the annular lock ring is in the set position, the energizing ring having an engaging portion with a corrugated shape in cross section to form an interference fit between the annular lock ring and the second wellhead member when the energizing ring is in the engaged position.

16. The method according to claim 15, further comprising forming the corrugated shape of the energizing ring in cross section as concentric ridges and valleys.

17. The method according to claim 15, wherein the annular lock ring is biased radially outward and moving the annular lock ring to the engaged position includes retracting the annular lock ring with the energizing ring to engage the annular lock groove on the outer diameter surface of the first wellhead member.

18. The method according to claim 15, wherein the annular lock ring is biased radially inward and moving the annular lock ring to the engaged position includes expanding the annular lock ring with the energizing ring to engage the annular lock groove on the outer diameter surface of the first wellhead member.

19. The method according to claim 15, wherein moving the energizing ring axially within the annulus between the unengaged position and the engaged position includes moving the energizing ring until an end of the energizing ring engages an annular stop shoulder within the annulus when the energizing ring is in the engaged position.

20. The method according to claim 15, further comprising providing a constant radial force on the annular lock ring with the energizing ring over a length of the corrugated shape of the engaging portion.

* * * * *